US010378394B2

(12) United States Patent
Pawade et al.

(10) Patent No.: US 10,378,394 B2
(45) Date of Patent: Aug. 13, 2019

(54) CAM SHAFT PHASER WITH CRANKSHAFT DRIVEN ROTOR

(71) Applicant: Schaeffler Technologies AG & Co. KG, Herzogenaurach (DE)

(72) Inventors: Vaishnavi Pawade, Rochester Hills, MI (US); Jason Durfee, Troy, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 7 days.

(21) Appl. No.: 15/815,762

(22) Filed: Nov. 17, 2017

(65) Prior Publication Data

US 2019/0153907 A1 May 23, 2019

(51) Int. Cl.
*F01L 1/344* (2006.01)
*F01L 1/02* (2006.01)

(52) U.S. Cl.
CPC ..... *F01L 1/344* (2013.01); *F01L 1/026* (2013.01)

(58) Field of Classification Search
CPC ..... F01L 2001/3445; F01L 2001/34469; F01L 2001/34479; F01L 2001/34496; F01L 1/46
USPC ..... 123/90.17
See application file for complete search history.

(56) References Cited

U.S. PATENT DOCUMENTS

| | | | | |
|---|---|---|---|---|
| 7,305,948 | B2 | 12/2007 | Heintzen et al. | |
| 8,113,160 | B2 | 2/2012 | Methley | |
| 2005/0109299 | A1* | 5/2005 | Takahashi | F01L 1/02 123/90.17 |
| 2011/0139105 | A1* | 6/2011 | Watanabe | F01L 1/3442 123/90.38 |
| 2013/0255610 | A1* | 10/2013 | Weber | F01L 1/344 123/90.15 |
| 2016/0160775 | A1* | 6/2016 | Endo | F02P 5/1504 123/2 |

* cited by examiner

*Primary Examiner* — Jorge L Leon, Jr.

(57) ABSTRACT

A cam shaft phaser, including: an axis of rotation; a rotor arranged to receive torque from an engine and including a plurality of radially outwardly extending protrusions; a stator including a plurality of radially inwardly extending protrusions; and a plurality of chambers. Each chamber is circumferentially bounded by first and second radially outwardly extending protrusions. A respective radially inwardly extending protrusion is located in each chamber.

16 Claims, 11 Drawing Sheets

CAM SHAFT PHASER WITH CRANKSHAFT DRIVEN ROTOR

TECHNICAL FIELD

The present disclosure relates to a cam shaft phaser with a rotor arranged to receive rotational torque and a stator rotatable with respect to the rotor. In particular, a cam shaft is non-rotatably connected to the rotor and the stator provides rotational torque to another cam shaft phaser and cam shaft.

BACKGROUND

Known configurations for cam shaft phasers, in which a stator receives torque from an engine and the rotor is rotated with respect to the stator to phase a cam shaft connected to the rotor may not be desirable for certain power train configurations.

SUMMARY

According to aspects illustrated herein, there is provided a cam shaft phaser, including: an axis of rotation; a rotor arranged to receive torque from an engine and including a plurality of radially outwardly extending protrusions; a stator including a plurality of radially inwardly extending protrusions; and a plurality of chambers. Each chamber is circumferentially bounded by first and second radially outwardly extending protrusions. A respective radially inwardly extending protrusion is located in each chamber.

According to aspects illustrated herein, there is provided a cam shaft phaser, including: an axis of rotation; a rotor including a plurality of radially outwardly extending protrusions and a plurality of slots; a stator including a plurality of axially extending protrusion, each axially extending protrusion disposed in a respective slot and a plurality of radially inwardly extending protrusions; and a plurality of chambers, each chamber circumferentially bounded by first and second radially inwardly extending protrusions. A respective radially inwardly extending protrusion is located in each chamber. A line, parallel to the axis of rotation, passes through a chamber and a slot.

According to aspects illustrated herein, there is provided a cam shaft phaser, including: an axis of rotation; a rotor including a plurality of radially outwardly extending protrusions and a plurality of slots, each slot including a planar radially innermost surface and a curved radially outermost surface; a stator including a plurality of axially extending protrusion, each axially extending protrusion disposed in a respective slot and a plurality of radially inwardly extending protrusions; and a plurality of chambers, each chamber circumferentially bounded by first and second radially outwardly extending protrusions. A respective radially inwardly extending protrusion is located in each chamber.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 11:
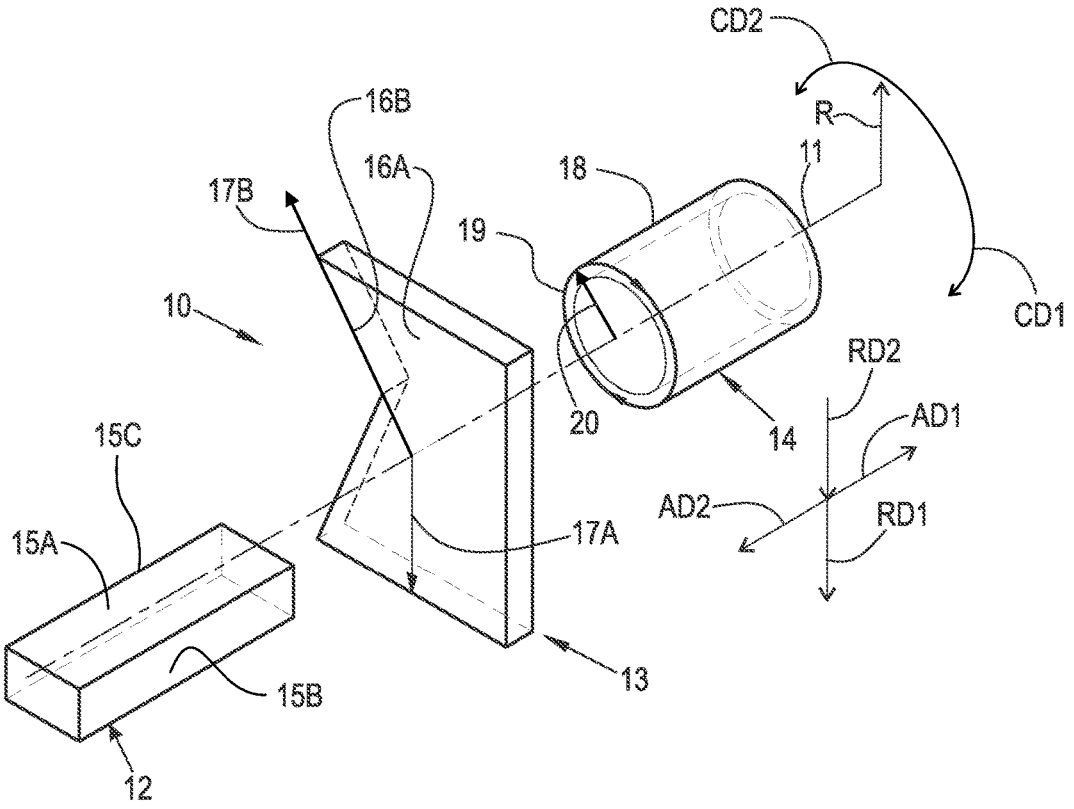

FIG. 11 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 20, passes through surface 18.

Axial movement is in axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
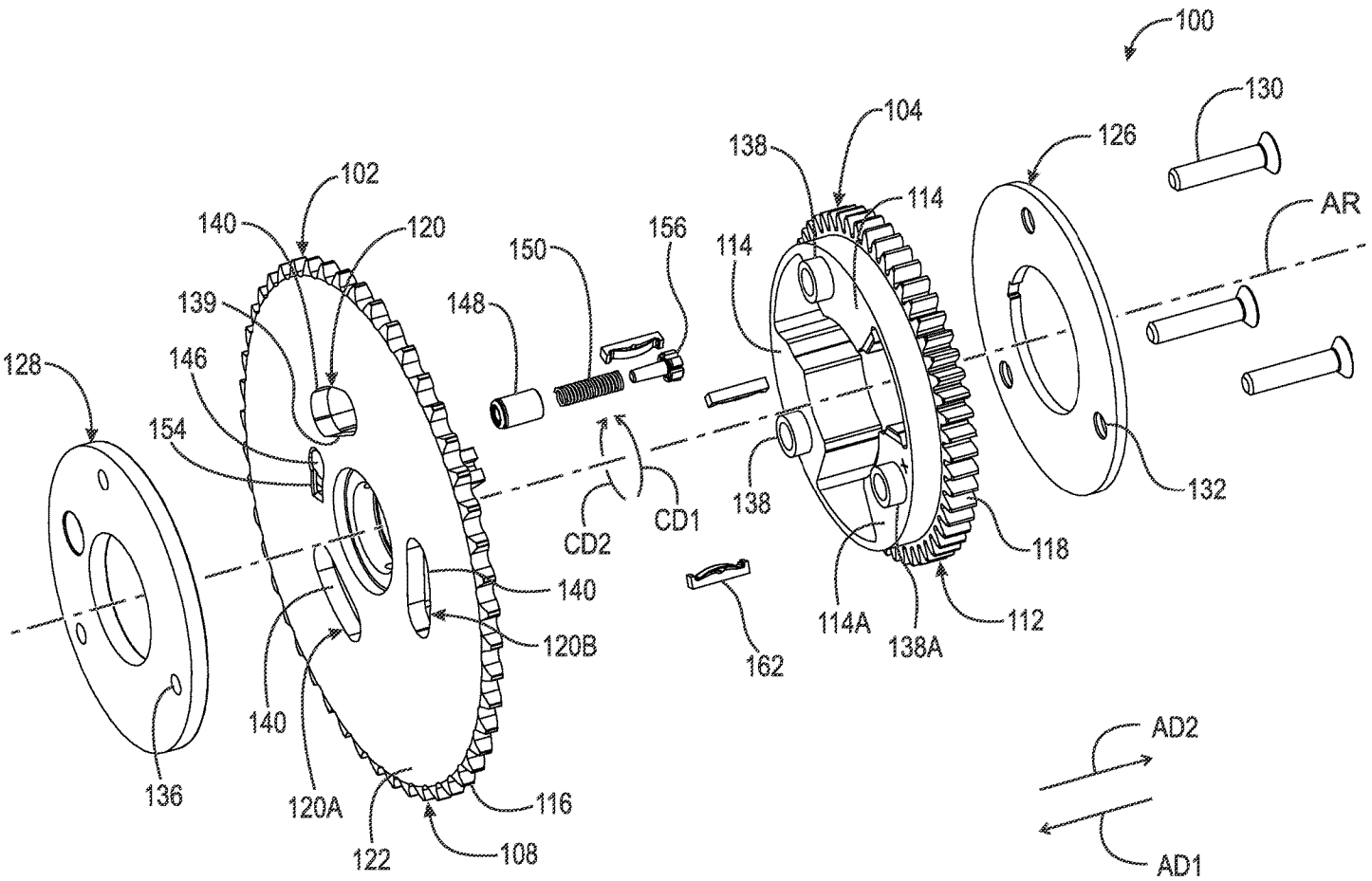
FIG. 1 is a front perspective view of an example cam shaft phaser with crankshaft driven rotor.

FIG. 1 is a front perspective view of example cam shaft phaser 100 with a crankshaft driven rotor.

Figure 2:
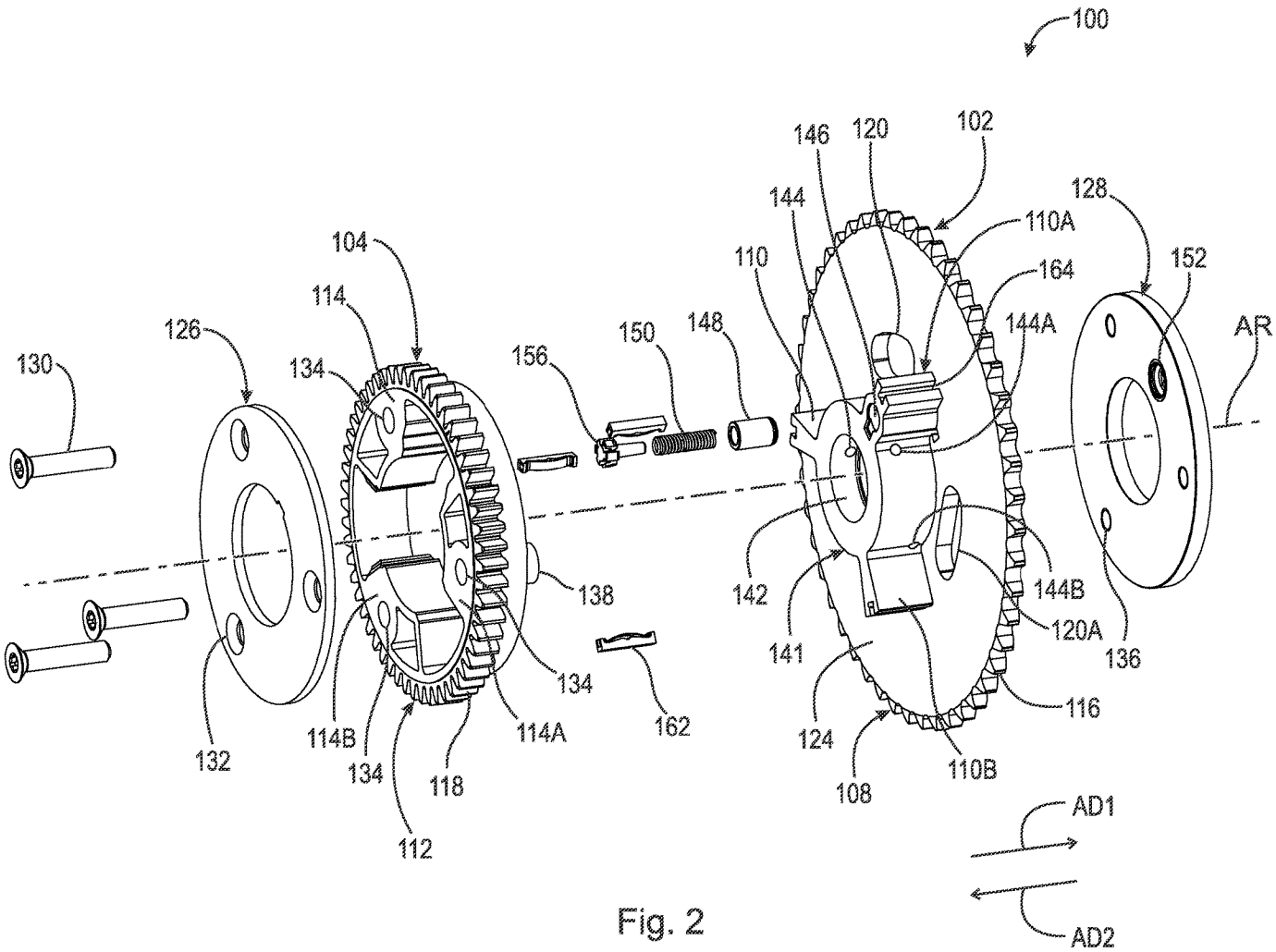
FIG. 2 is a back perspective view of the cam shaft phaser shown in FIG. 1.

FIG. 2 is a back perspective view cam shaft phaser 100 shown in FIG. 1.

Figure 3:
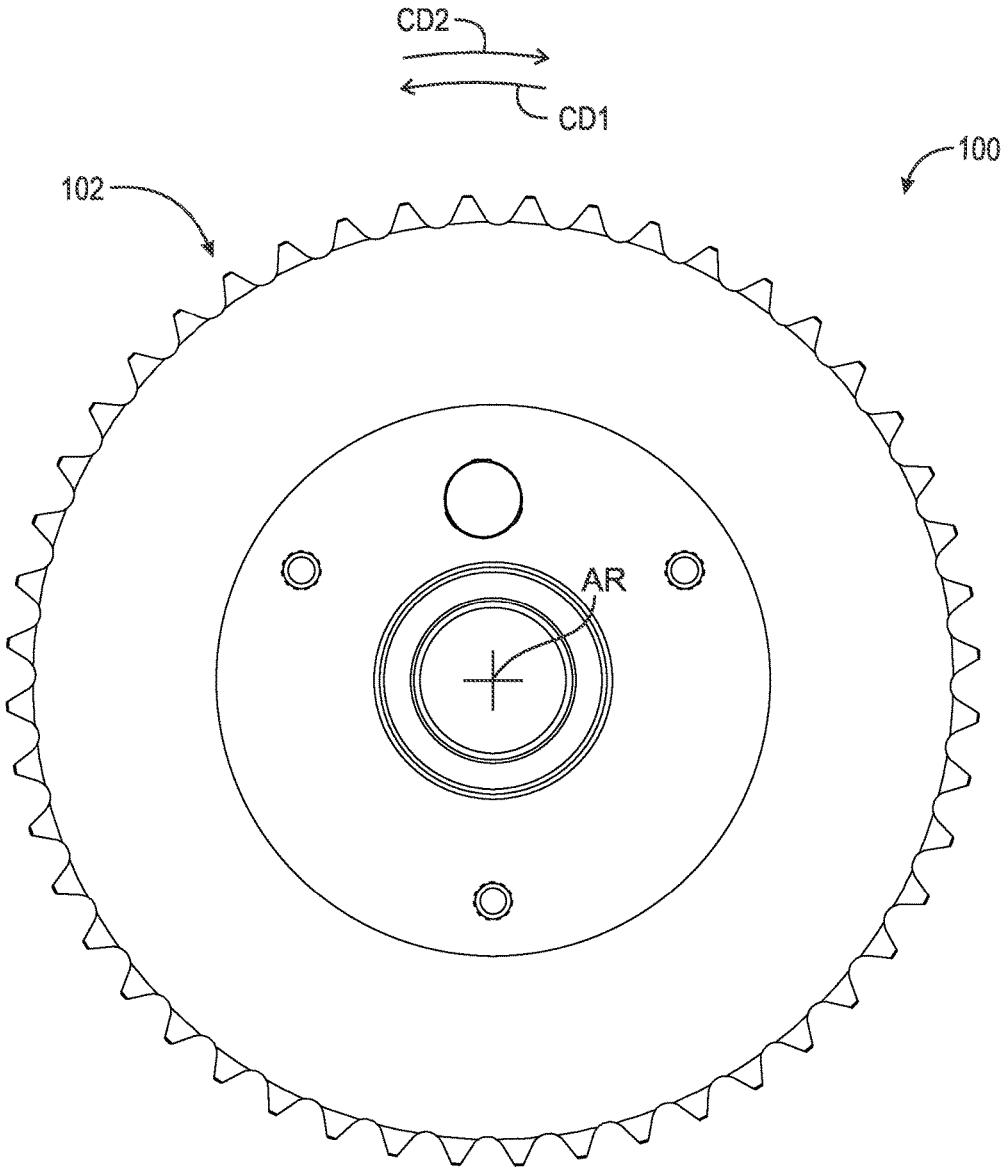
FIG. 3 is a front view of the cam shaft phaser shown in FIG. 1.

FIG. 3 is a front view of cam shaft phaser 100 shown in FIG. 1.

Figure 4:
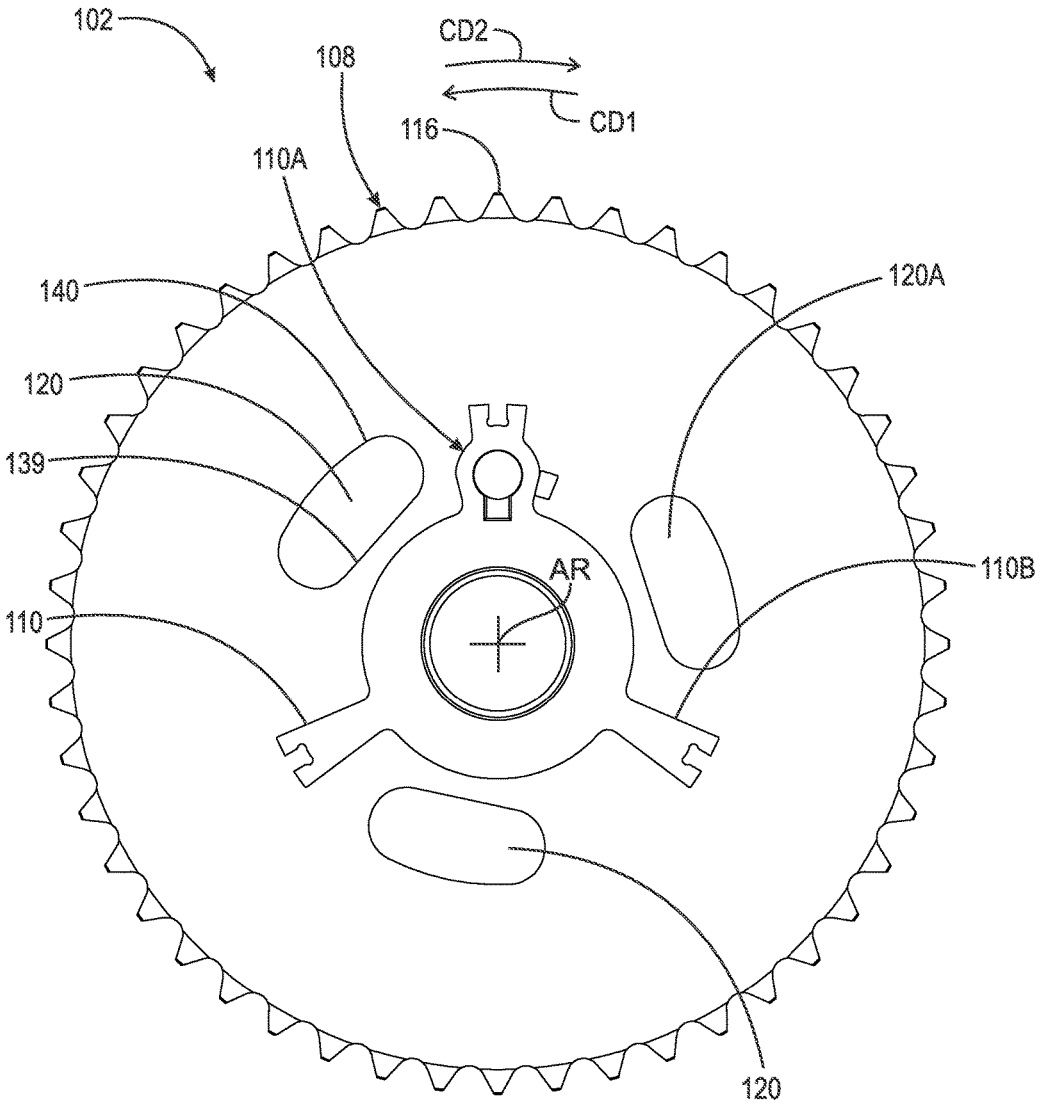
FIG. 4 is a back view of a rotor shown in FIG. 1.

FIG. 4 is a back view of a rotor shown in FIG. 1.

Figure 5:
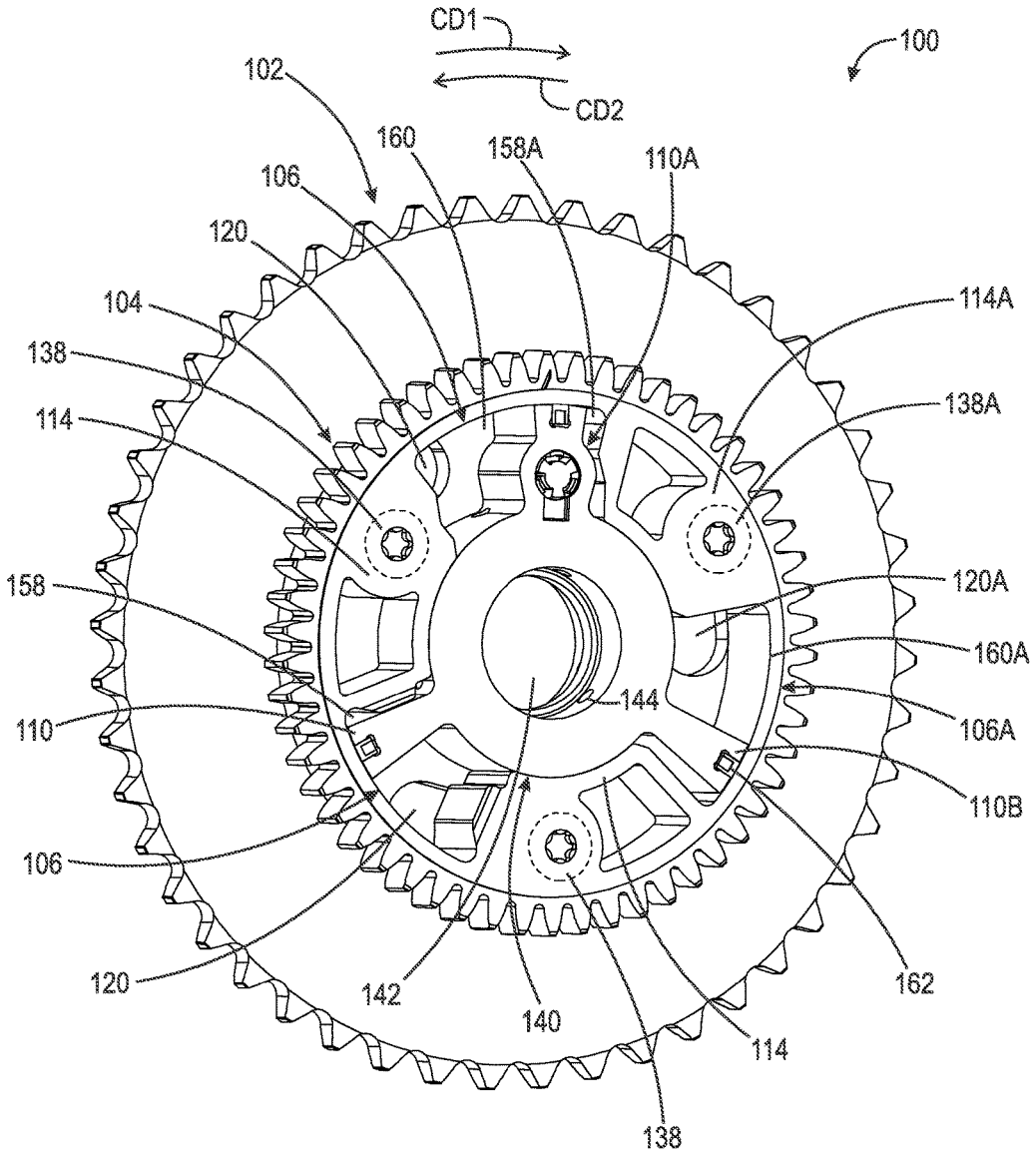
FIG. 5 is a perspective back view of the cam shaft phaser shown in FIG. 1 with a sealing cover removed.

FIG. 5 is a perspective back view of cam shaft phaser 100 shown in FIG. 1 with a sealing cover removed.

Figure 6:
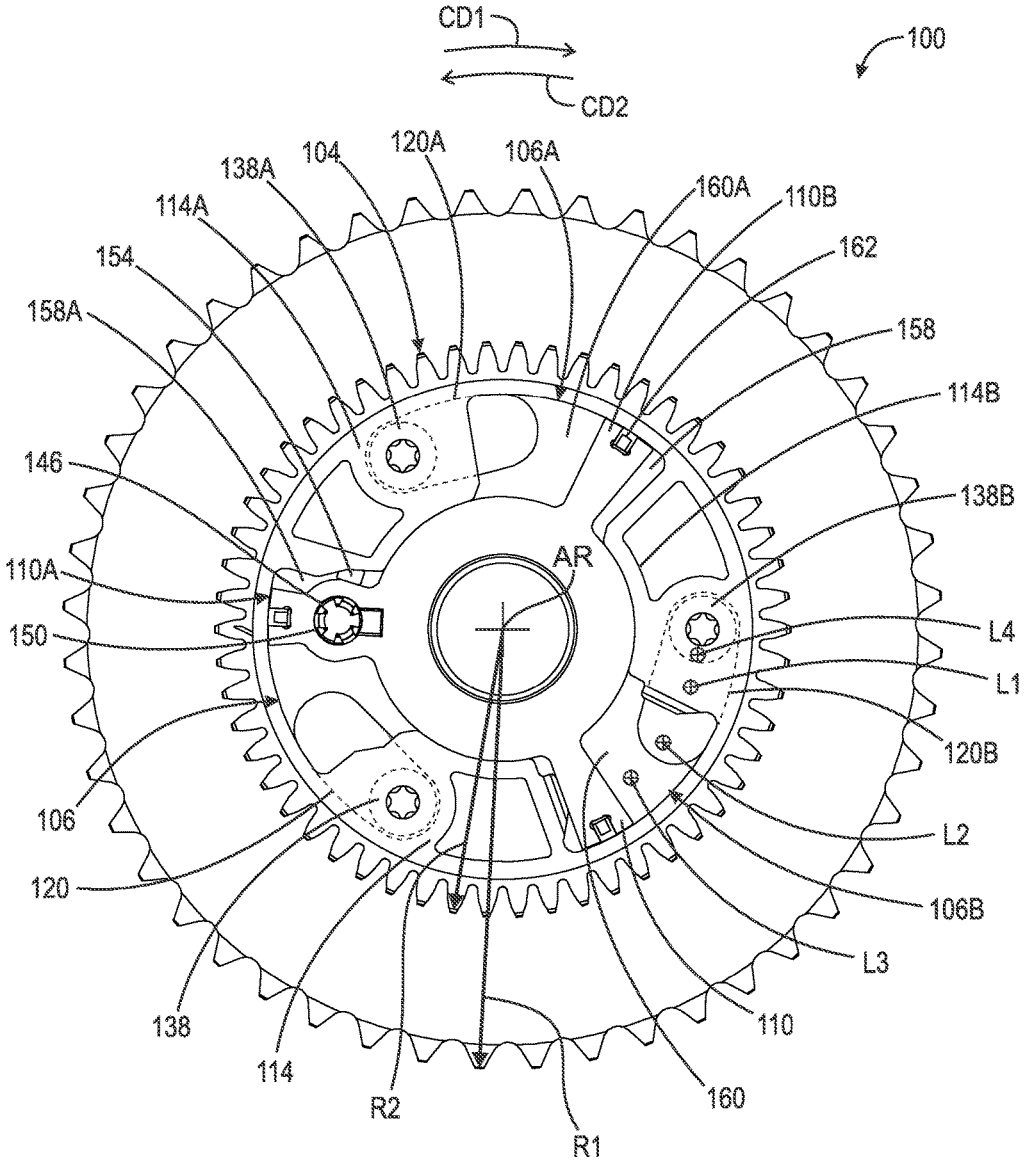
FIG. 6 is a back view of the cam shaft phaser shown in FIG. 1 with the sealing cover removed.

FIG. 6 is a back view of cam shaft phaser 100 shown in FIG. 1 with the sealing cover removed. The following should be viewed in light of FIGS. 1 through 6. Cam shaft phaser 100 includes: axis of rotation AR; rotor 102; stator 104; and chambers 106. Rotor 102 includes: radially outermost surface 108; outer radius R1; and radially outwardly extending protrusions 110. Stator 104 includes: radially outermost surface 112; outer radius R2; and radially inwardly extending protrusions 114. In an example embodiment, radius R2 is less than radius R1. In an example embodiment, surface 108 includes teeth 116 and surface 112 includes teeth 118.

FIG. 6 is a back view of cam shaft phaser 100 shown in FIG. 1 with the sealing cover removed.

Figure 7:
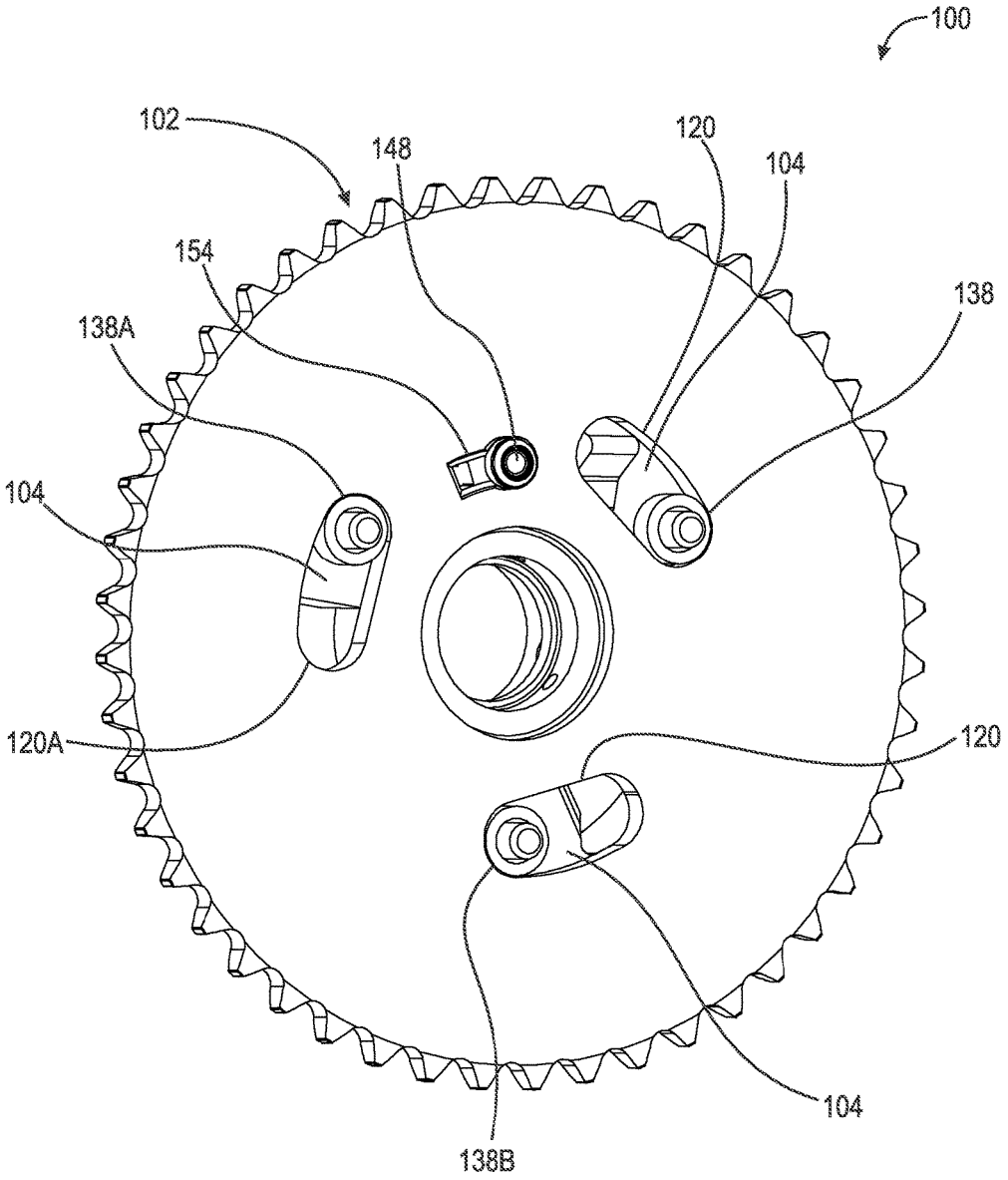
FIG. 7 is a perspective front view of the cam shaft phaser shown in FIG. 1 with a locking cover removed.

FIG. 7 is a perspective front view of cam shaft phaser 100 shown in FIG. 1 with a locking cover removed.

Figure 8:
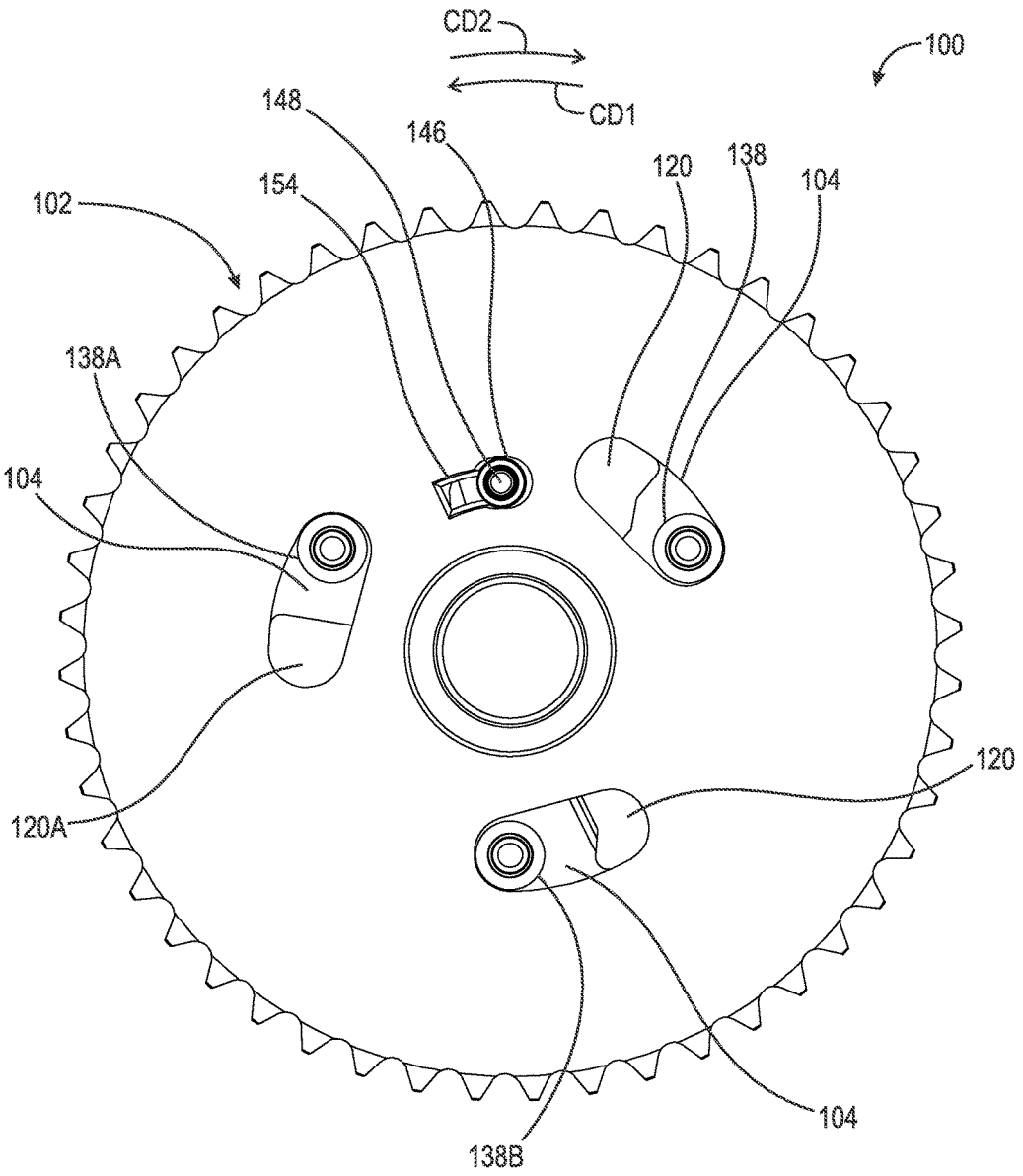
FIG. 8 is a front view of the cam shaft phaser shown in FIG. 1 with the locking cover removed.

FIG. 8 is a front view of cam shaft phaser 100 shown in FIG. 1 with the locking cover removed. The following should be viewed in light of FIGS. 1 through 8. Each chamber 106 is circumferentially bounded by a pair of circumferentially adjacent radially outwardly extending protrusions 110. A respective radially inwardly extending protrusion 114 is located in each chamber 106. For example: chamber 106A is circumferentially bounded by circumferentially adjacent radially outwardly extending protrusions 110A and 110B; and radially inwardly extending protrusion 114A is located in chamber 106A. A reference character "[number][number][number][letter]" represents a specific example of a group of elements "[number][number][number]." For example, chamber 106A is a specific example of chambers 106.

As further described below, stator 104 is rotatable with respect to rotor 102 and rotor 102 is not rotatable with respect to stator 104. That is, rotor 102 is the relative ground for cam shaft phaser 100 and phasing is performed by rotating stator 104 with respect to rotor 102.

Rotor 102 includes slots 120. Slots 120 connect axial sides 122 and 124 of rotor 102, facing in axial directions AD1 and AD2, respectively. In an example embodiment, cam shaft phaser 100 includes sealing cover 126, locking cover 128 and fasteners 130. Fasteners 130 pass through: through-bores 132 in cover 126; through-bores 134 in protrusions 114; and slots 120. Fasteners 130 thread into threaded bores 136 in cover 128, and non-rotatably connect sealing cover 126, stator 104, and locking cover 128. Therefore, stator 104 and covers 126 and 128 are rotatable with respect to rotor 102. Rotor 102 and stator 104 are axially disposed between covers 126 and 128. In an example embodiment, stator 104 is axially disposed between sealing cover 126 and rotor 102; and rotor 102 is axially disposed stator 104 and locking cover 128. In an example embodiment (not shown), rotor 102 is axially disposed between sealing cover 126 and stator 104; and stator 104 is axially disposed rotor 102 and locking cover 128. By "non-rotatably connected" components, we mean that: the components are connected so that whenever one of the components rotates, all the components rotate; and relative rotation between the components is not possible. Radial and/or axial movement of non-rotatably connected components with respect to each other is possible, but not required.

Stator 104 includes axially extending protrusions 138. Each protrusion 138 extends in axial direction AD1 from a respective protrusion 114. For example, protrusion 138A extends from protrusion 114A in direction AD1. Through-bores 134 pass through axially extending protrusions 138. Each axially extending protrusion 138 is at least partially disposed in a respective slot 120. For example, protrusion 138A is partially disposed in slot 120A. Stator 104 is rotatable with respect to rotor 102 to circumferentially displace each axially extending protrusion 138 within the respective slot 120. In an example embodiment, each slot 120 includes planar radially innermost surface 139 and radially outermost surface 140 curved in circumferential direction CD1.

Line L1, in axial direction AD1, passes through radially inwardly extending protrusion 114B and slot 120B without passing through chamber 106B. Line L2, in axial direction AD1, passes through chamber 106B and slot 120B. Line L3, in axial direction AD1, passes through chamber 106B and stator 104 without passing through slot 120B. Line L4 passes through protrusion 138B and slot 120B without passing through chamber 106B.

Figure 9:
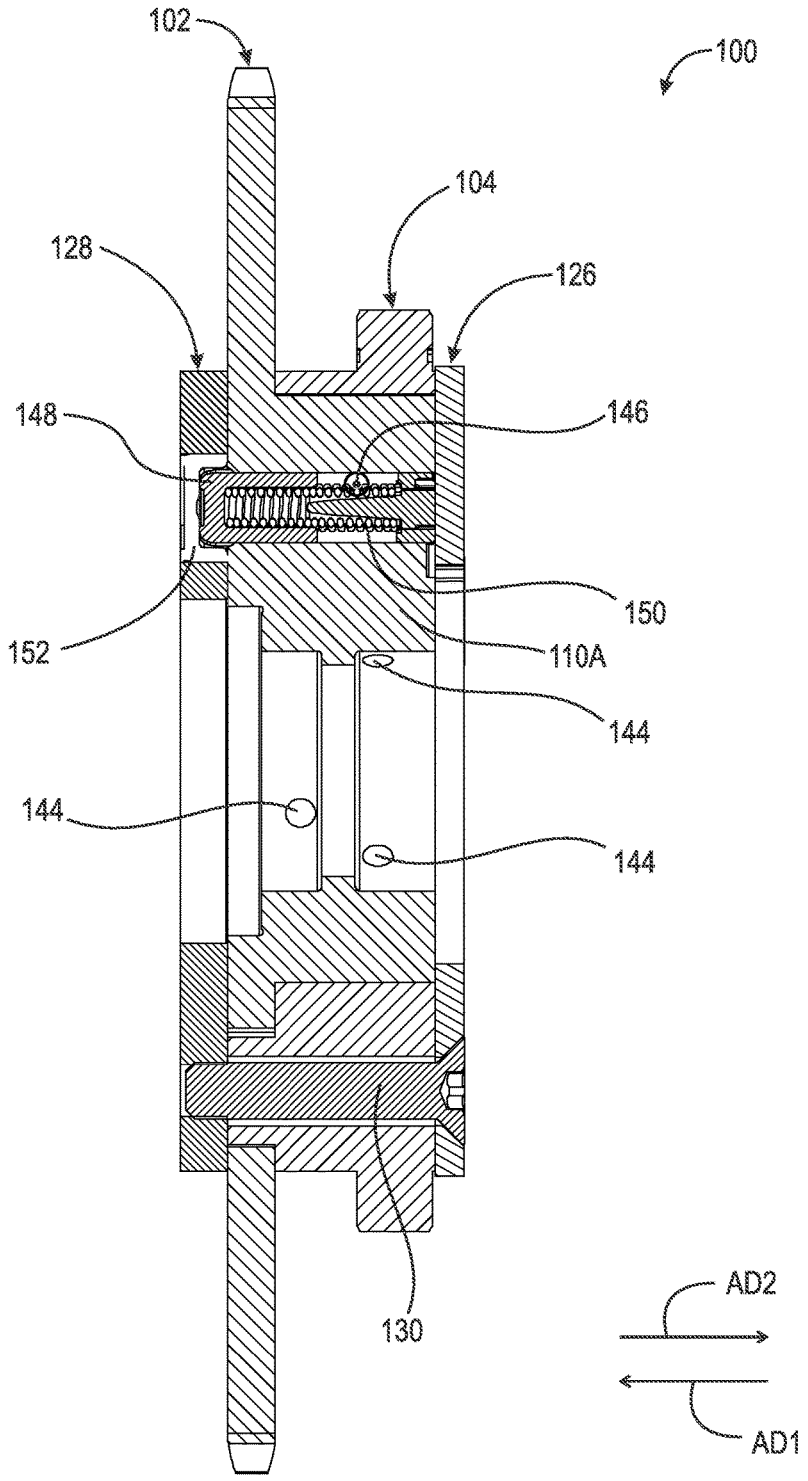
FIG. 9 is a cross-sectional view generally along line 9-9 in FIG. 3.

FIG. 9 is a cross-sectional view generally along line 9-9 in FIG. 3. In an example embodiment, rotor 102 includes hub 141. Hub 141 includes central opening 142 through which axis AR passes and supply channels 144. Protrusions 110 extend radially outwardly from hub 141. As is known in the art, fluid is transmitted into chambers 106 and is drained from chambers 106 via channels 144.

In an example embodiment: protrusion 110A includes slot 146; cam shaft phaser 100 includes locking pin 148 and spring 150, each disposed in slot 146; cover 128 includes indentation 152; and rotor 102 includes channel 154 connecting chamber 106A and slot 146. In an example embodiment, cam shaft phaser 100 includes spring support 156. Spring 150 urges pin 148 in axial direction AD1. In a first position for pin 148, which is a locked mode for cam shaft phaser 100, spring 150 displaces pin 148 in direction AD1 and into indentation 152, non-rotatably connecting cover 128, rotor 102, stator 104 and cover 126. Non-rotatably connecting rotor 102 to cover 128 non-rotatably connects rotor 102 to stator 104 and cover 126.

The discussion that follows assumes an advance phase adjustment entails rotating stator 104 in circumferential direction CD1 with respect to rotor 102, and a retard phase adjustment entails rotating stator 104 in circumferential direction CD2 with respect to rotor 102. In the example of FIGS. 1 through 9, each chamber 106 includes a respective advance chamber 158 and a respective retard chamber 160. Each chamber 158 is circumferentially bounded in directions CD1 and CD2 by a protrusion 114 and a protrusion 110, respectively. Each chamber 160 is circumferentially bounded in directions CD1 and CD2 by a protrusions 110 and a protrusion 114, respectively. For example: advance chamber 158A is circumferentially bounded in directions CD1 and CD2 by protrusions 114A and 110A, respectively; and retard chamber 160A is circumferentially bounded in directions CD1 and CD2 by protrusions 110B and 114A, respectively. In an example embodiment, seals 162 in slots 164 in protrusions 110 seal chambers 158 from chambers 160. In the example of FIGS. 1 through 9: channel 154 connects slot 146 and chamber 158A; and channels 144A and 144B supply and drain fluid from chambers 158A and 160A, respectively.

To transition from the locked mode to an unlocked mode, in which stator 104 is rotatable with respect to rotor 102, fluid is supplied to chamber 158A by channel 144A. The fluid flows through channel 154 to slot 146 and displaces pin 148 in direction AD2, against the urging of spring 150, to disengage pin 148 from indentation 152.

Figure 10:
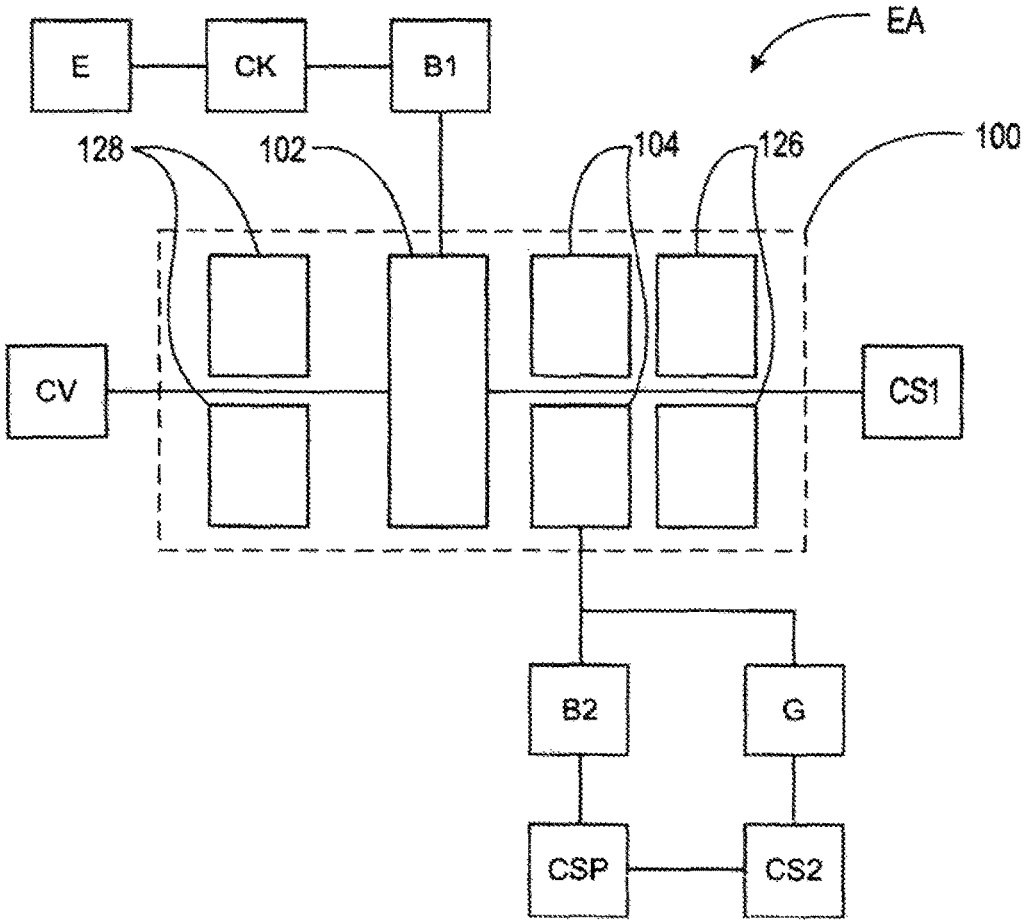
FIG. 10 is a block diagram of an engine assembly including the cam shaft phaser shown in FIG. 1; and, FIG. 11 is a perspective view of a cylindrical coordinate system demonstrating spatial terminology used in the present application.

FIG. 10 is a block diagram of engine assembly EA including cam shaft phaser 100 shown in FIG. 1. In the example of FIG. 10, cam shaft CS1 is non-rotatably connected to rotor 102 and belt (or chain) B1 is connected to teeth 116 of rotor 102 and crankshaft CK for engine E. Therefore, crankshaft CK rotates rotor 102 and cam shaft CS1. Stator 104 is used to rotate cam shaft CS2. For example: cam shaft phaser CSP is connected to cam shaft phaser 100 by belt (or chain) B2 to teeth 118 of stator 104; belt B2 transmits rotational torque to cam shaft phaser CSP; and phaser CSP rotates cam shaft CS2. For example: teeth 118 are mated with gear G on cam shaft CS2; and stator 104 rotates and phases cam shaft CS2 via gear G. Phasing cam shaft CS2 with respect to cam shaft CS1 is accomplished by rotating stator 104 with respect to rotor 102.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
RD1 radial direction
RD2 radial direction
CD1 circumferential direction
CD2 circumferential direction
R radius
12 object
13 object
14 object
15A surface
15B surface
15C edge
16A surface
16B edge
17A radius
17B radius
18 surface
19 circumference
20 radius
AR axis of rotation
B1 belt or chain
B2 belt or chain
CK crank shaft
CS1 cam shaft
CS2 cam shaft
CSP cam shaft phaser
CV control valve
E engine
G gear
L1 axial line
L2 axial line
L3 axial line
L4axial line
R1 outer radius, rotor
R2 outer radius, stator
100 cam shaft phaser
102 rotor
104 stator
106 chamber
106A chamber
106B chamber
108 radially outermost surface, rotor
110 radially outwardly extending protrusion, rotor
110A radially outwardly extending protrusion, rotor
110B radially outwardly extending protrusion, rotor
112 radially outermost surface, stator
114 radially inwardly extending protrusion, stator
114A radially Inwardly extending protrusion, stator
114B radially inwardly extending protrusion, stator
116 teeth, rotor
118 teeth, stator
120 slot, rotor
120A slot, rotor
CS2 cam shaft
CSP cam shaft phaser
CV control valve
E engine
EA engine assembly
G gear
L1 axial line
L2 axial line
L3 axial line
L4 axial line
R1 outer radius, rotor
R2 outer radius, stator
100 cam shaft phaser
102 rotor
104 stator
106 chamber
106A chamber
106B chamber
108 radially outer most surface, rotor
110 radially outwardly extending protrusion, rotor
110A radially outwardly extending protrusion, rotor
110B radially outwardly extending protrusion, rotor
112 radially outermost surface, stator
114 radially inwardly extending protrusion, stator
114A radially, inwardly extending protrusion, stator
114B radially Inwardly extending protrusion, stator
116 teeth, rotor
118 teeth, stator
120 slot, rotor
120A slot, rotor
120B slot, rotor
122 axial side, rotor
124 axial side, rotor
126 sealing cover
128 locking cover
130 fastener

132 through-bore, sealing cover
134 through-bore, stator
136 threaded bore, locking cover
138 axially extending protrusion, stator
138A axially extending protrusion, stator
138B axially extending protrusion, stator
139 surface, slot 120
140 surface, slot 120
141 hub, rotor
142 central opening, rotor
144 supply channel, rotor
144A supply channel, rotor
146 slot, rotor
142 locking pin
144 channel, rotor
146 slot, rotor
148 locking pin
150 spring
152 indentation, locking cover
154 channel, rotor
156 spring support
158 advance chamber
158A advance chamber
160 retard chamber
160A retard chamber
162 seal
164 slot, rotor

The invention claimed is:

1. A cam shaft phaser, comprising:
an axis of rotation;
a rotor including a plurality of radially outwardly extending protrusions;
a stator including a plurality of radially inwardly extending protrusions; and,
a plurality of chambers, wherein each chamber is circumferentially bounded by a respective first radially outwardly extending protrusion of the plurality of radially outwardly extending protrusions and by a respective second radially outwardly extending protrusion of the plurality of radially outwardly extending protrusions; wherein a respective radially inwardly extending protrusion of the plurality of radially inwardly extending protrusions is located in each chamber; and wherein the rotor is arranged to receive torque directly from an engine, and the stator is arranged to receive the torque from the rotor.

2. The cam shaft phaser of claim 1, wherein the rotor is arranged to non-rotatably connect to a cam shaft.

3. The cam shaft phaser of claim 1, wherein the stator is rotatable with respect to the rotor.

4. The cam shaft phaser of claim 1, wherein the rotor has a first outer radius, the stator has a second outer radius, and the second outer radius is less than the first outer radius.

5. The cam shaft phaser of claim 1, further comprising:
a sealing cover;
a locking cover; and,
a plurality of fasteners non-rotatably connecting the sealing cover, the stator, and the locking cover, wherein the stator is axially disposed between the sealing cover and the rotor, and the rotor is axially disposed between the stator and the locking cover.

6. The cam shaft phaser of claim 1, wherein the rotor includes a first axial side facing in a first axial direction, a second axial side facing in a second axial direction, opposite the first axial direction, and a plurality of slots connecting the first axial side with the second axial side; wherein the stator includes a plurality of axially extending protrusions, and each axially extending protrusion is at least partially disposed in a respective slot of the plurality of slots; and wherein the stator is rotatable with respect to the rotor to circumferentially displace each axially extending protrusion within the respective slot.

7. The cam shaft phaser of claim 6, further comprising:
a sealing cover;
a locking cover; and,
a plurality of fasteners passing through the plurality of slots, and non-rotatably connecting the sealing cover, the stator, and the locking cover.

8. The cam shaft phaser of claim 6, wherein each slot includes a planar radially innermost surface, and a curved radially outermost surface.

9. The cam shaft phaser of claim 1, wherein the rotor includes a first axial side facing in a first axial direction, a second axial side facing in a second axial direction, opposite the first axial direction, and a plurality of slots connecting the first axial side with the second axial side; wherein the stator includes a plurality of axially extending protrusions, and each axially extending protrusion is at least partially disposed in a respective slot of the plurality of slots; and wherein a first line, in an axial direction, passes through a radially inwardly extending protrusion of the plurality of radially inwardly extending protrusions and a slot of the plurality of slots, or a second line, in an axial direction passes through a chamber of the plurality of chambers and a slot of the plurality of slots, or a third line, in an axial direction, passes through an axially extending protrusion of the plurality of axially extending protrusions and a slot of the plurality of slots.

10. The cam shaft phaser of claim 1, further comprising:
a pin, wherein the rotor includes a central opening through which the axis of rotation passes, at least one first through-bore connecting the central opening with a chamber of the plurality of chambers and arranged to transmit fluid to the chamber and to drain the fluid from the chamber, a radially outwardly extending protrusion of the plurality of radially outwardly extending protrusions with a slot, a second through-bore connecting the slot with the chamber; and wherein the pin is disposed in the slot, in a first position for the pin, the pin non-rotatably connects the stator and the rotor, and the second through-bore is arranged to transmit the fluid from the chamber to the slot to axially displace the pin to a second position in which the pin is disengaged from the stator.

11. The cam shaft phaser of claim 1, wherein each chamber is divided into an advance chamber and a retard chamber by a respective inwardly extending protrusion of the plurality of radially inwardly extending protrusions.

12. A cam shaft phaser, comprising:
an axis of rotation;
a rotor including a plurality of radially outwardly extending protrusions, and a plurality of slots;
a stator including a plurality of axially extending protrusions, each axially extending protrusion disposed in a respective slot of the plurality of slots, and a plurality of radially inwardly extending protrusions; and,
a plurality of chambers, each chamber circumferentially bounded by a respective first radially inwardly extending protrusion of the plurality of radially inwardly extending protrusions and by a respective second radially inwardly extending protrusion of the plurality of radially inwardly extending protrusions, wherein a respective radially outwardly extending protrusion of the plurality of radially outwardly extending protrusions is located in each chamber, and a line, parallel to the axis of rotation, passes through a chamber of the plurality of chambers and a slot of the plurality of slots.

13. The cam shaft phaser of claim 12, further comprising:

a sealing cover;

a locking cover; and, a plurality of fasteners, wherein the rotor is axially located between the stator and the locking cover, the stator is axially located between the sealing cover and the rotor, and each fastener passes through a respective slot of the plurality of slots; and wherein the plurality of fasteners non-rotatably connects the sealing cover, the stator and the locking cover.

14. The cam shaft phaser of claim 13, wherein each fastener passes through a respective axially extending protrusion of the plurality of axially extending protrusions.

15. The cam shaft phaser of claim 12, wherein the stator is rotatable with respect to the rotor, and each axially extending protrusion is circumferentially displaceable within the respective slot.

16. A cam shaft phaser, comprising:

an axis of rotation;

a rotor including a plurality of radially outwardly extending protrusions, and a plurality of slots, each slot including a planar radially innermost surface, and a curved radially outermost surface;

a stator including a plurality of axially extending protrusions, each axially extending protrusion disposed in a respective slot of the plurality of slots, and a plurality of radially inwardly extending protrusions; and, a plurality of chambers, each chamber circumferentially bounded by a respective first radially outwardly extending protrusion of the plurality of radially outwardly extending protrusions and by a respective second radially outwardly extending protrusion of the plurality of radially outwardly extending protrusions, wherein a respective radially inwardly extending protrusion of the plurality of radially inwardly extending protrusions is located in each chamber.

* * * * *